US006684776B2

(12) United States Patent
Cote et al.

(10) Patent No.: US 6,684,776 B2
(45) Date of Patent: Feb. 3, 2004

(54) METHOD AND APPARATUS FOR DETERMINING SLIPPING IN A NIP ROLLER

(75) Inventors: Kevin Lauren Cote, Durham, NH (US); Neil Doherty, Durham, NH (US); Michael Roger Perreault, Rochester, NH (US); Lothar John Schroeder, Portsmouth, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 141 days.

(21) Appl. No.: 09/795,076

(22) Filed: Feb. 23, 2001

(65) Prior Publication Data

US 2002/0117068 A1 Aug. 29, 2002

(51) Int. Cl.[7] ..... B41F 13/54
(52) U.S. Cl. ..... 101/228; 101/219
(58) Field of Search ..... 101/228, 219, 101/216, 483; 400/617, 618; 242/534; 226/30, 42

(56) References Cited

U.S. PATENT DOCUMENTS 3,556,509 A * 1/1971 Crum ..... 226/28
3,948,425 A * 4/1976 Bala ..... 226/136
4,794,429 A * 12/1988 Acquaviva ..... 271/197
6,024,683 A * 2/2000 Wilkes ..... 493/196
6,085,490 A * 7/2000 Buchko ..... 242/396.8
6,168,333 B1 * 1/2001 Merz et al. ..... 400/579
6,176,410 B1 * 1/2001 Ueda et al. ..... 226/4
6,213,367 B1 * 4/2001 Flamm ..... 226/42

FOREIGN PATENT DOCUMENTS

JP 11-286358 3/1998

* cited by examiner

*Primary Examiner*—Anthony H. Nguyen
(74) *Attorney, Agent, or Firm*—Davidson, Davidson & Kappel, LLC

(57) ABSTRACT

A method for determining the presence of slipping of a driven nip roller relative to the web in a web printing press includes systematically changing the speed of the nip driver while monitoring the corresponding change in web tension difference across the nip. The linearity and a slope of the relationship between the tension difference and the speed of the nip driver are determined. When the tension difference is non-linear relative to the speed of the driver or the slope of the relationship is substantially less than an expected slope, then slipping is determined to be present. An operator slip indication may be provided which includes the direction of the slip, positive or negative. The operator may then take corrective action to re-establish a non-slip condition, or automatic corrective actions may ensue.

30 Claims, 3 Drawing Sheets

METHOD AND APPARATUS FOR DETERMINING SLIPPING IN A NIP ROLLER

BACKGROUND OF THE INVENTION

1. Field of the Invention

The present invention relates generally to web printing presses and more particularly to a method and apparatus for determining the presence of slipping of a driven nip roller in a web printing press.

2. Background Information

Web printing presses print a continuous web of material, such as paper. The web travels through nips formed by opposing nip rollers. The web is moved on its way by driven nip rollers which are driven by respective nip roller drivers. Slipping of the driven nip rollers relative to the web can adversely affect printing press performance. With non-slipping driven nips attenuation of tension disturbances is reduced.

Tension in the web must be maintained within a desired range in order to achieve smooth operation of the printing press. At the same time, the velocity of the web, and hence the rotational speed of non-slip nip rollers, must be held relatively constant to achieve good print product quality. Tension in a web span between two nips can be adjusted by controlling the speed of the nip roller driver in the downstream nip.

The press operator has had no simple way to determine whether a driven nip roller is slipping or not. Even if the press operator determines that a driven nip roller is slipping, reestablishing a non-slip condition of the nip roller can be difficult and time-consuming because, among other things, the operator may not be able to easily determine whether the nip roller is slipping in a positive direction, i.e., where the tangential speed of the nip roller is greater than the speed of the web, or whether the nip roller is slipping in a negative direction, i.e., where the tangential speed of the nip roller is less than the speed of the web. Additionally, a driven nip roller may be non-slipping at one nominal, or command, press speed and transition to slipping at another nominal press speed. This transition may not degrade the operation of the press enough to prompt operator intervention, yet the slipping may reduce attenuation of tension disturbances to unacceptable levels.

Japanese Patent Document No. JP11286358 purports to describe a slip restraint control method for a roller conveying a band of metal. When slipping takes place, the speed of rotation of the motor driving the roller is changed to vary between the slipping range and the non-slipping range, while monitoring the current to the motor. An optimum motor speed is determined based on the resulting data.

What is needed is a way to automatically determine and indicate a slipping nip roller condition.

BRIEF SUMMARY OF THE INVENTION

An object of the present invention is to provide a method and apparatus for determining the presence of slipping of a driven nip roller in a web printing press.

The present invention provides a method for determining the presence of slipping of a driven nip roller of a nip relative to a web passing through the nip in a web printing press, the method comprising: causing a plurality of changes in a speed of a driver driving the nip roller; monitoring a respective change in the difference in tension in the web upstream and downstream of the nip upon each respective change of the speed of the driver so as to determine a linearity and a slope of a relationship between the difference in tension and the speed of the driver; and determining the presence of slipping when the difference in tension is non-linear with respect to the speed of the driver or the slope is substantially less than an expected slope.

The presence of non-slipping of the driven nip roller is determined when the difference in tension is linear with respect to the speed of the driver and the slope is near the expected slope.

The expected slope may be a function of an estimated or measured modulus of a material of the web.

The plurality of changes in speed may include an increase in speed and/or a decrease in speed.

An operator indication of the presence, as well as the direction, of the slipping may be provided.

In the presence of slipping, the tension set point of a web tension control system for the web upstream of the nip may be increased, by the press operator, for example, so as to achieve a non-slipping of the driven nip roller. Depending on the operating mode of the press, the velocity ratio of a driver control system of the driver may be increased so as to achieve a non-slipping of the driven nip roller.

Alternatively, in the presence of slipping the force urging together the nip rollers of the nip may be increased so as to achieve a non-slipping of the driven nip roller.

The present invention may further comprise: determining a first tension range for the web upstream of the nip, the nip roller being non-slipping in the first tension range; and controlling the driver so as to maintain the tension in the web upstream of the nip in the first tension range. In an embodiment of the present invention, the tension may be maintained at a value near the middle of the first tension range.

The present invention may further comprise: determining a speed range of the driver at a predetermined difference in tension, the nip roller being non-slipping when the speed of the driver is in the speed range; and controlling the driver so as to maintain the speed of the driver in the speed range. In an embodiment of the method according to the present invention, the speed may be maintained at a value near the middle of the speed range.

The printing press may include a second nip upstream of the nip and a third nip downstream of the nip, with the second nip including a second driven nip roller and the third nip including a third driven nip roller. The method according to the present invention may further comprise controlling the second driven and/or the third driven nip roller so as to establish a desired value of the difference in tension. The driven nip roller is preferably non-slipping when the difference in tension is at the desired value.

The method according to the present invention may further comprise: determining a speed range of the driver at a predetermined difference in tension, the driven nip roller being non-slipping when the speed of the driver is in the speed range; and controlling the driver so as to maintain the speed of the driver in the speed range. In an embodiment of the method according to the present invention, the speed of the driver at a value near a middle of the speed range.

The present invention also provides a method for determining the presence of slipping of a driven nip roller of a nip relative to a web passing through the nip in a web printing press, the method comprising: causing a plurality of changes in a speed of a driver driving the nip roller; monitoring a respective change in a tension in the web upstream of the nip upon each respective change of the speed of the driver so as to determine a linearity and a slope of a relationship between the tension and the speed of the driver; and determining the presence of slipping when the tension is non-linear with respect to the speed of the driver or the slope is substantially less than an expected slope.

Additionally, the present invention provides a method for determining the presence of slipping of a driven nip roller of a nip relative to a web passing through the nip in a web printing press, the method comprising: causing a plurality of changes in a speed of a driver driving the nip roller; monitoring a respective change in a torque of the driver upon each respective change of the speed of the driver so as to determine a linearity and a slope of a relationship between the torque and the speed of the driver; and determining the presence of slipping when the torque is non-linear with respect to the speed of the driver or the slope is substantially less than an expected slope.

The present invention also provides an apparatus for determining the presence of slipping of a driven nip roller of a nip relative to a web passing through the nip in a web printing press. A first tension sensor is disposed upstream of the nip and having a first tension output being a function of a tension in the web upstream of the nip. A second tension sensor is disposed downstream of the nip and having a second tension output being a function of a tension in the web downstream of the nip. A driver is provided for driving the driven nip roller. A processor is provided for causing a plurality of changes in a speed of the driver. The processor receives the first and second tension outputs and determines for each of the changes in speed a respective difference in tension in the web upstream and downstream of the nip based on the first and second tension outputs so as to determine a linearity and a slope of a relationship between the difference in tension and the speed of the driver. The processor determines that slipping is present when the difference in tension is non-linear with respect to the speed of the driver or the slope is substantially less than an expected slope.

An indication device may be included for providing an operator indication of the presence, as well as the direction, of the slipping based on an output from the processor.

The processor may be included in a press tension control system.

The processor may be designed to carry out the various embodiments and aspects of the method according to the present invention described above. For example, the processor may implement one or more algorithms for performing the method according to the present invention.

BRIEF DESCRIPTION OF THE DRAWINGS

The present invention is elaborated upon below with reference to the drawings, in which.

DETAILED DESCRIPTION

Figure 1:
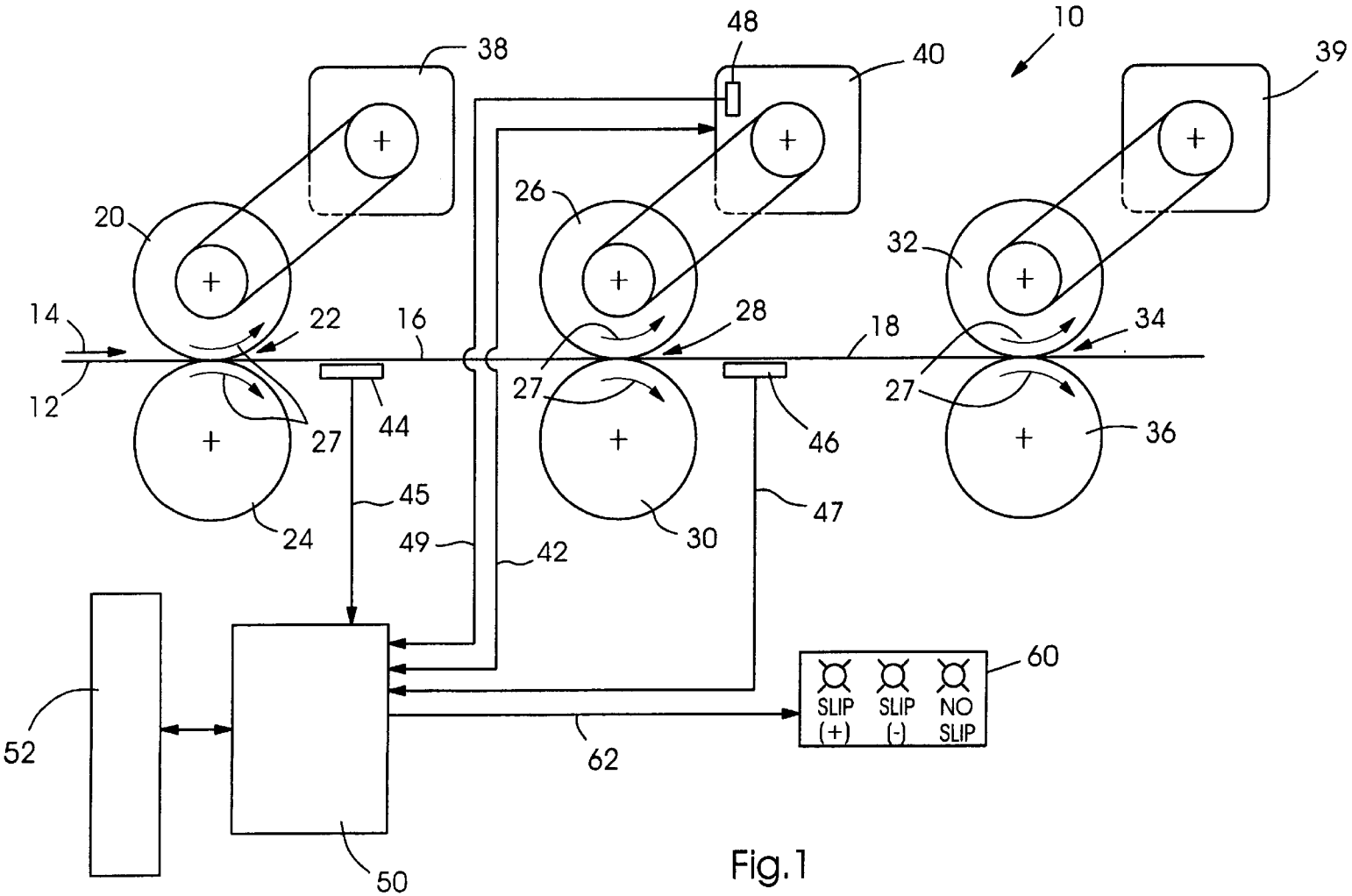
FIG. 1 shows a schematic diagram of an embodiment of an apparatus for determining a presence of a slipping driven nip roller of a nip in a web printing press, using a change in tension difference.

FIG. 1 shows a schematic diagram of an apparatus for determining a presence of a slipping driven nip roller in a web printing press 10. Web 12 is moved by driven nips 22, 28 and 34 in the direction indicated by arrow 14. Nips 22, 28 and 34 are formed by nip rollers 20 and 24, 26 and 30, and 32 and 36, respectively. Nips 22, 28 and 34 are designed to be non-slip nips. Nip rollers 22 and 24, 26 and 30, and 32 and 36 rotate as indicated by arrows 27. Nip rollers 20, 26 and 32 are non-slip driven nip rollers driven by nip roller drivers 38, 40 and 39, respectively. Nip roller drivers 38, 40 and 39 may be, for example, electric motors, or other type of suitable drivers. Upstream web span 16 is formed between nips 22 and 28, while downstream web span 18 is formed between nips 28 and 34. The discussion below focuses on nip 28 and associated nip roller 26 and driver 40, but a similar discussion could apply to nips 22 and 34, depending on the configuration of printing press 10.

Upstream from nip 28, tension sensor 44 provides tension signal 45, which is proportional to the tension in upstream web span 16, to processor 50. Downstream from nip 28, tension sensor 46 provides tension signal 47, which is proportional to the tension in downstream web span 18, to processor 50. Tension sensors 44 and 46 may each be, for example, a transducer, or other type of device for sensing the tension in a web span. Processor 50 exchanges information 42, including nip roller driver speed information, with nip roller driver 40, and sends slip status indication signal 62 to slip indication device 60.

Processor 50 systematically causes the speed of nip roller driver 40 to be increased and/or decreased relative to a nominal driver speed corresponding to the nominal, or command, press speed. The systematic speed changing may be in accordance with a predetermined algorithm, for example. Using tension sensors 44 and 46, processor 50 monitors the change in web span tension across nip 28 corresponding to each increase and decrease in the speed of nip roller driver 40. Processor 50 uses this data to determine the relationship, especially the linearity and slope of the relationship, of the tension difference between upstream web span 16 and downstream web span 18 to the speed of nip roller driver 40 using known mathematical techniques. Processor 50 may be a microprocessor, for example, or other processing device. Processor 50 interacts with tension control system 52. Alternatively, processor 50 may be integrated into tension control system 52. Tension control system 52 controls the tension in web spans 16 and 18, and may include, for example, a proportional plus integral tension controller.

Based on the determined relationship between the speed of nip roller 26 and the tension difference between web span 16 and 18, processor 50 outputs slip status indication signal 62 to slip status indicator 60. When the web tension difference is determined to be linearly dependent on nip roller speed, at an appropriate slope, nip roller 26 is considered to be non-slipping and a "NO-SLIP" indication is displayed on indicator 60, as shown in FIG. 1. An appropriate slope of the relationship of the web tension difference to the nip roller speed is a slope that is not substantially less than an expected slope based on a measured or estimated modulus of the material of web 12. When the determined relationship between the web tension difference and nip roller speed is non-linear, then nip roller 26 is considered to be slipping and a "SLIP" indication is displayed on indicator 60, as shown in FIG. 1. Additionally, nip roller 26 is considered to be slipping when the determined slope of the relationship between the web tension difference and nip roller speed is significantly lower, for example by a predetermined amount, than an expected slope based on a measured or estimated modulus of the material of web 12. Here, too, is the "SLIP" indication displayed on indicator 60.

For a slipping nip roller 26, processor 50 also determines whether the nip roller is slipping in a positive or negative direction, using known techniques based on the speed versus tension data gathered during the systematic speed changes. Indicator 60 accordingly displays a "+" or "−" as shown in FIG. 1. When the speed of nip roller 26 at nip 28 is greater than the speed of web 14, then the nip roller is considered to be slipping in the positive direction. When the speed of nip roller 26 at nip 28 is less than the speed of web 14, then the nip roller is considered to be slipping in the negative direction.

Figure 2:
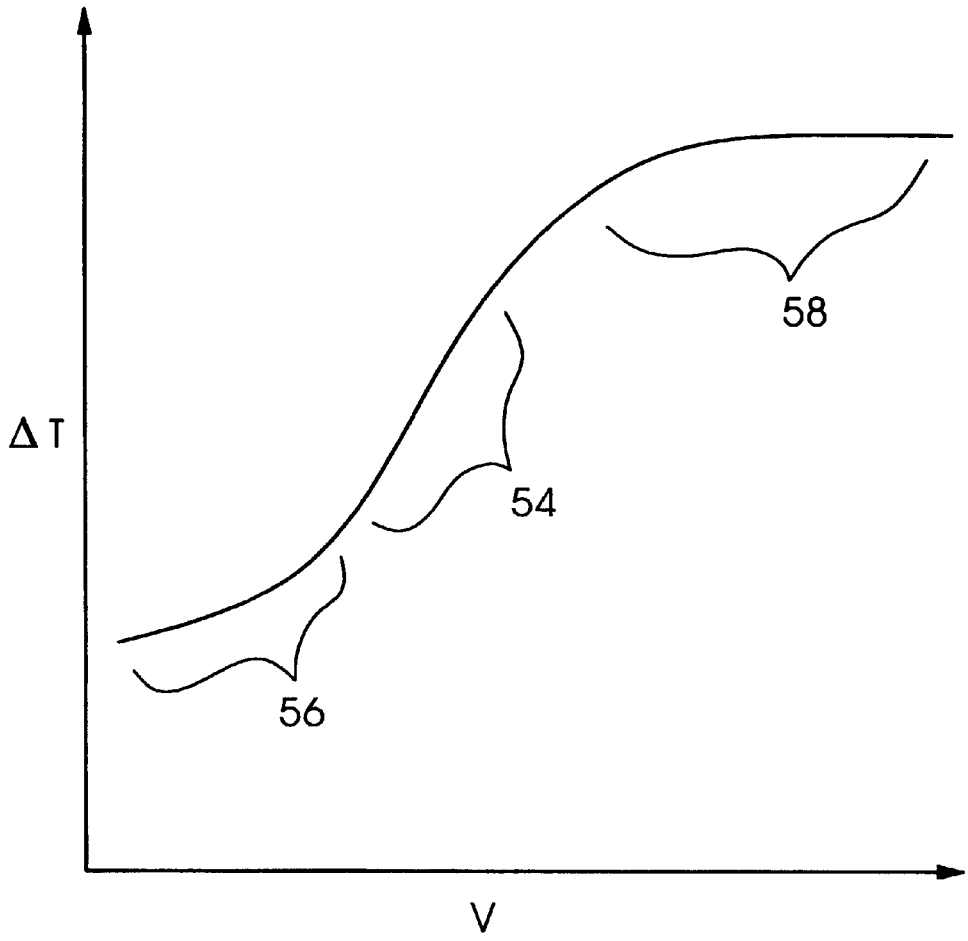
FIG. 2 shows a graph of the difference in tension across a nip in a web printing press as a function of a velocity of a nip roller.

FIG. 2 shows a graph of the difference in web span tension (ΔT) across a nip in a web printing press as a function of the speed (V) of a driven nip roller of the nip. In region 54, the difference in web span tension is linear with respect to the nip roller speed, indicating that the nip roller is non-slipping relative to the web. In region 58, the nip roller is slipping in the positive direction, i.e., the speed of the nip roller at the nip is greater than the velocity of the web. In region 56, the nip roller is slipping in the negative direction, i.e., the speed of the nip roller at the nip is less than the velocity of the web. Referring additionally again to FIG. 1, processor 50 determines which region of the graph nip roller 26 is operating in and produces a corresponding signal 62 to indicator 60.

When printing press 10 is operating in a tension-control mode, in which tension controller 52 maintains the tension in web spans 16 and 18, processor 50 may continuously monitor the slip/non-slip condition of nip 26 relative to the speed changes caused by the tension control system. If a slip speed of the nip is reached, then the appropriate slip indication is displayed on indicator 60. Press operator action may then be taken to change the tension set point of tension controller 52 for upstream web span 16 so as to achieve a non-slipping condition of nip roller 26. In an embodiment of the present invention, processor 50 can be designed to determine a non-slip tension range and automatically move the tension set point to be in the range, and preferably to be in a mid portion of the range.

When printing press 10 is operating a velocity-control mode, in which nip roller driver 40 maintains nip roller 26 at a nominal speed, upon a slip indication operator action may be taken to change a velocity ratio value of driver 40 so as achieve a non-slip state of the nip roller. The velocity ratio as used here means a value proportional to a ratio of the speed of driver 40 needed to produce a given desired tension in upstream web span 16 to a value of command speed of printing press 10. Alternatively, operator or automatic action may be taken to increase the force urging nip rollers 26 and 30 together so as to achieve a non-slipping condition. In an embodiment of the present invention, processor 50 can be designed to determine a range of non-slip velocity ratio values and automatically set the velocity ratio for driver 40 to be in the range, and preferably to be in a mid portion of the range.

In another embodiment according to the present invention, only upstream tension transducer 44 may be used, without downstream transducer 46. Processor 50 in this embodiment monitors the change in web span tension in upstream web span 16, instead of the change in web span tension across nip 28, corresponding to each change in the speed of nip roller driver 40. Non-slip and slip determinations may otherwise be carried out in this embodiment similarly to the manner in which the non-slip and slip determinations are performed in the embodiment in which the change in web span tension across nip 28 is monitored, as described above.

Figure 3:
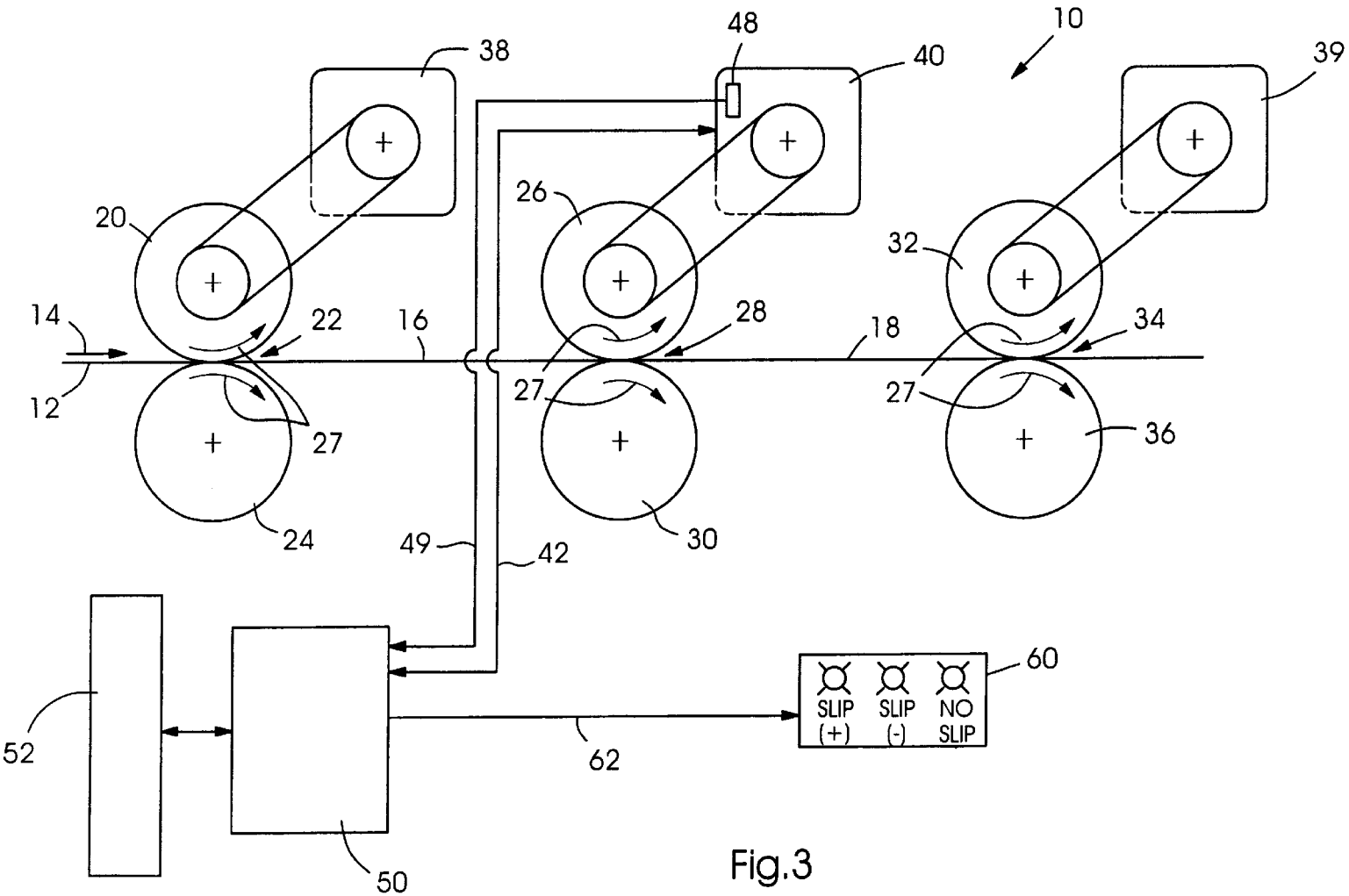
FIG. 3 shows a schematic diagram of another embodiment of an apparatus for determining a presence of a slipping driven nip roller of a nip in a web printing press, using a change in torque.

Referring now to FIG. 3, in another embodiment according to the present invention, driver torque sensor 48 senses the torque of nip roller driver 40 and provides a corresponding signal 49 to processor 50. Processor 50 causes systematic speed changes in nip roller driver 40, as above, but in this embodiment processor 50 monitors the corresponding changes in the torque of nip roller driver 40. Similarly to the embodiments described above, in which tension values are monitored, when the driver torque is determined to be linearly dependent on nip roller speed, at an appropriate slope, nip roller 26 is considered to be non-slipping and a "NO-SLIP" indication is displayed on indicator 60. When the determined relationship between the driver torque and nip roller speed is non-linear, then nip roller 26 is considered to be slipping and a "SLIP" indication is displayed on indicator 60. Additionally, nip roller 26 is considered to be slipping when the determined slope of the relationship between the driver torque and nip roller speed is significantly lower, for example by a predetermined amount, than an expected slope. Here, too, is the "SLIP" indication displayed on indicator 60. The expected slope may be based on a measured or estimated modulus of the material of web 12. The relationship between nip roller driver torque and nip roller speed is graphically similar to the difference in web span tension (ΔT) across the nip as a function of the speed (V) of the driven nip roller. See FIG. 2.

In some embodiments according to the present invention, processor 50 may be designed to determine the tension set point for downstream web span 18, and/or the velocity ratio for nip roller driver 39 of downstream nip 34 so as to develop a non-slip condition at nip 28.

Other variations and embodiments of the present invention, beyond those described herein, are possible. The present invention is intended to be limited only by the scope of the appended claims.

What is claimed is:

1. A method for determining a presence of a slipping of a driven nip roller of a nip relative to a web passing through the nip in a web printing press, the method comprising:

causing a plurality of changes in a speed of a driver driving the nip roller;

monitoring a respective change in a difference in tension in the web upstream and downstream of the nip upon each respective change of the speed of the driver so as to determine a linearity and a slope of a relationship between the difference in tension and the speed of the driver; and determining the presence of the slipping when the difference in tension is non-linear with respect to the speed of the driver or the slope is substantially less than an expected slope.

2. The method as recited in claim 1 further comprising determining a presence of a non-slipping of the driven nip roller when the difference in tension is linear with respect to the speed of the driver and the slope is near the expected slope.

3. The method as recited in claim 1 wherein the expected slope is a function of an estimated or measured modulus of a material of the web.

4. The method as recited in claim 1 wherein the plurality of changes in speed include at least one of an increase in speed and a decrease in speed.

5. The method as recited in claim 1 further comprising providing an operator indication of the presence of the slipping.

6. The method as recited in claim 1 further comprising providing an operator indication of a direction of the slipping.

7. The method as recited in claim 1 further comprising increasing a tension set point of a web tension control system for the web upstream of the nip so as to achieve a non-slipping of the driven nip roller.

8. The method as recited in claim 1 further comprising increasing a velocity ratio of a driver control system of the driver so as to achieve a non-slipping of the driven nip roller.

9. The method as recited in claim 1 wherein the nip includes another nip roller opposite the driven nip roller and further comprising increasing a force urging the driven nip roller and the other nip roller together so as to achieve a non-slipping of the driven nip roller.

10. The method as recited in claim 1 further comprising:

determining a first tension range for the web upstream of the nip, the nip roller being non-slipping in the first tension range; and controlling the driver so as to maintain the tension in the web upstream of the nip in the first tension range.

11. The method as recited in claim 10 wherein the controlling the driver is performed so as to maintain the tension in the web upstream of the nip at a value near the middle of the first tension range.

12. The method as recited in claim 1 further comprising:

determining a speed range of the driver at a predetermined difference in tension, the nip roller being non-slipping when the speed of the driver is in the speed range; and controlling the driver so as to maintain the speed of the driver in the speed range.

13. The method as recited in claim 12 wherein the controlling the driver is performed so as to maintain the speed of the driver at a value near a middle of the speed range.

14. The method as recited in claim 1 wherein the printing press further includes a second nip downstream of the nip, the second nip including a second driven nip roller, and further comprising:

controlling the second driven nip roller so as to establish a desired value of the difference in tension.

15. The method as recited in claim 14 wherein the driven nip roller is non-slipping when the difference in tension is at the desired value.

16. The method as recited in claim 14 further comprising determining a speed range of the driver at a predetermined difference in tension, the driven nip roller being non-slipping when the speed of the driver is in the speed range; and controlling the driver so as to maintain the speed of the driver in the speed range.

17. The method as recited in claim 16 wherein the controlling the driver is performed so as to maintain the speed of the driver at a value near a middle of the speed range.

18. A method for determining a presence of a slipping of a driven nip roller of a nip relative to a web passing through the nip in a web printing press, the method comprising:

causing a plurality of changes in a speed of a driver driving the nip roller;

monitoring a respective change in a tension in the web upstream of the nip upon each respective change of the speed of the driver so as to determine a linearity and a slope of a relationship between the tension and the speed of the driver; and determining the presence of the slipping when the tension is non-linear with respect to the speed of the driver or the slope is substantially less than an expected slope.

19. The method as recited in claim 18 wherein the expected slope is a function of an estimated or measured modulus of a material of the web.

20. The method as recited in claim 18 further comprising providing an operator indication of at least one of the presence of the slipping and a direction of the slipping.

21. A method for determining a presence of a slipping of a driven nip roller of a nip relative to a web passing through the nip in a web printing press, the method comprising:

causing a plurality of changes in a speed of a driver driving the nip roller;

monitoring a respective change in a torque of the driver upon each respective change of the speed of the driver so as to determine a linearity and a slope of a relationship between the torque and the speed of the driver; and determining the presence of the slipping when the torque is non-linear with respect to the speed of the driver or the slope is substantially less than an expected slope.

22. The method as recited in claim 21 wherein the expected slope is a function of an estimated or measured modulus of a material of the web.

23. The method as recited in claim 21 further comprising providing an operator indication of at least one of the presence of the slipping and a direction of the slipping.

24. An apparatus for determining a presence of a slipping of a driven nip roller apparatus for determining the presence of slipping of a driven nip roller of a nip relative to a web passing through the nip in a web printing press, the apparatus comprising:

a first tension sensor disposed upstream of the nip and having a first tension output being a function of a tension in the web upstream of the nip;

a second tension sensor disposed downstream of the nip and having a second tension output being a function of a tension in the web downstream of the nip;

a driver for driving the driven nip roller; and a processor causing a plurality of changes in a speed of the driver, the processor receiving the first and second tension outputs and determining for each of the changes in speed a respective difference in tension in the web upstream and downstream of the nip based on the first and second tension outputs so as to determine a linearity and a slope of a relationship between the difference in tension and the speed of the driver, the processor determining the presence of the slipping when the difference in tension is non-linear with respect to the speed of the driver or the slope is substantially less than an expected slope.

25. The apparatus as recited in claim 24 wherein the expected slope is a function of an estimated or measured modulus of a material of the web.

26. The apparatus as recited in claim 24 further comprising an indication device for providing an operator indication of the presence of the slipping based on an output from the processor.

27. The apparatus as recited in claim 24 wherein the indication device further provides an operator indication of the direction of the slipping.

28. The apparatus as recited in claim 24 wherein the processor is included in a press tension control system.

29. The apparatus as recited in claim 24 wherein the processor further determines a first tension range for the web upstream of the nip, the driven nip roller being non-slipping in the first tension range, and wherein the driver maintains the tension in the web upstream of the nip in the first tension range.

30. The apparatus as recited in claim 24 wherein the processor further determines a speed range of the driver for non-slipping of the driven nip roller at a predetermined value of the difference in tension and wherein the driver maintains the speed of the driver in the non-slip tension range.

* * * * *